US008757419B2

(12) United States Patent
Schessl et al.

(10) Patent No.: US 8,757,419 B2
(45) Date of Patent: Jun. 24, 2014

(54) CROCKERY BASKET COMPRISING HEIGHT-ADJUSTABLE RACKS

(75) Inventors: Bernd Schessl, Dillingen/Donau (DE); Rainer Schuetz, Neresheim (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1675 days.

(21) Appl. No.: 10/575,297

(22) PCT Filed: Oct. 14, 2004

(86) PCT No.: PCT/EP2004/052533

§ 371 (c)(1),
(2), (4) Date: Apr. 11, 2006

(87) PCT Pub. No.: WO2005/037050

PCT Pub. Date: Apr. 28, 2005

(65) Prior Publication Data

US 2007/0131696 A1 Jun. 14, 2007

(30) Foreign Application Priority Data

Oct. 14, 2003 (DE) ..... 103 47 765

(51) Int. Cl.
*A47F 7/00* (2006.01)

(52) U.S. Cl.
USPC ..... 220/489; 220/488; 220/487

(58) Field of Classification Search
USPC ..... 211/41.8, 41.9; 220/489, 488, 487, 486, 220/485
See application file for complete search history.

(56) References Cited

U.S. PATENT DOCUMENTS

| | | | | |
|---|---|---|---|---|
| 3,137,251 | A * | 6/1964 | Pendergrast, Jr. | 108/110 |
| 4,735,325 | A * | 4/1988 | Remmers | 211/187 |
| 4,917,248 | A * | 4/1990 | Friskney | 211/41.8 |
| 5,027,959 | A * | 7/1991 | Luukkonen | 211/186 |
| 5,158,185 | A * | 10/1992 | Michael et al. | 211/41.8 |
| 5,205,419 | A * | 4/1993 | Purtilo | 211/41.8 |

(Continued)

FOREIGN PATENT DOCUMENTS

| | | |
|---|---|---|
| DE | 1979788 U | 2/1968 |
| DE | 3022484 A1 | 1/1982 |

(Continued)

OTHER PUBLICATIONS

International Search Report forPCT/EP2004/05253.

(Continued)

*Primary Examiner* — Stephen Castellano
(74) *Attorney, Agent, or Firm* — James E. Howard; Andre Pallapies

(57) ABSTRACT

A crockery basket with racks for items to be washed in dishwasher machines is provided, wherein the height of the racks is variable. To this end, the crockery basket is provided with a number of holding elements, by which means at least one rack can be arranged at different heights in the crockery basket. In this way, at least one rack for an item to be washed can be fixed at various heights in the crockery basket according to the spatial requirements of the item to be placed in the crockery basket or on the rack. The possibilities for varying the position of the item to be washed in the crockery basket or on the rack are thus improved, and the space available in the crockery basket is better used.

8 Claims, 3 Drawing Sheets

(56) References Cited

U.S. PATENT DOCUMENTS

| | | | | | |
|---|---|---|---|---|---|
| 5,351,837 | A | * | 10/1994 | Smith | 211/41.8 |
| 5,431,294 | A | * | 7/1995 | Stottmann et al. | 220/23.4 |
| 5,480,035 | A | | 1/1996 | Smith | |
| 5,695,078 | A | | 12/1997 | Otema | |
| 8,042,559 | B2 | * | 10/2011 | Choi et al. | 134/137 |
| 2003/0089672 | A1 | | 5/2003 | VanLandingham | |

FOREIGN PATENT DOCUMENTS

| | | | |
|---|---|---|---|
| DE | 94 02 372 | | 4/1994 |
| DE | 9216330 | U1 | 4/1994 |
| DE | 296 21 528 | | 4/1998 |
| DE | 201 04 929 | | 6/2001 |
| EP | 0 367 559 | | 5/1990 |
| EP | 0 797 949 | | 10/1997 |
| WO | WO 01/87133 | | 11/2001 |

OTHER PUBLICATIONS

Report of Examination DE 103 47 765.9 dates Nov. 7, 2013.

* cited by examiner

CROCKERY BASKET COMPRISING HEIGHT-ADJUSTABLE RACKS

This application is the national stage (Rule 371) of PCT/EP04/52533 filed Oct. 4, 2004.

The invention relates to a crockery basket comprising height-adjustable rack for use in dishwashers.

A dishwasher usually comprises a washing container in which the items to be washed are accommodated and cleaned with washing liquid. In order to ensure that the items to be washed are securely deposited in the washing container and the items to be washed are cleaned as efficiently as possible, one or a plurality of crockery baskets for placement of the items to be washed are provided in the washing container. Crockery baskets comprising one or a plurality of racks for receiving items to be washed in a certain manner are already known, such as shelves for receiving cups or glasses for example. The known racks have the disadvantage that they are fixed at a certain height on the crockery basket and thus restrict the possibilities for varying the arrangement of the items to be washed in the crockery basket or on the rack.

In a further known crockery basket, the racks are pivotally fixed at a certain height on the crockery basket so that, if required, they can be brought into a horizontal position in which they can be filled with items to be washed or they can be brought into a vertical position to enlarge the storage space in the crockery basket. These known racks also have the disadvantage that they are fixed at a specific height on the crockery basket and therefore only offer the choice between using or folding up the rack without increasing the possibilities for varying the arrangement of the items to be washed in the crockery basket or on the rack.

One object of the present invention is to provide a crockery basket for use in dishwashers wherein the height position of the racks in the crockery basket can be variably configured to improve the possibilities for varying the arrangement of the items to be washed in the crockery basket and on the rack.

This object is solved by the crockery basket according to the invention with features described herein. Advantageous further developments are also described.

The crockery basket for dishwashers according to the invention comprises at least one rack for arranging items to be washed, a number of holding elements being provided by which means the at least one rack can be arranged at different height positions on the crockery basket.

The crockery basket for dishwashers according to the invention has the advantage that one or a plurality of racks for items to be washed can be fixed at different height positions on the crockery basket. As a result, the possibilities for varying the arrangement of the items to be washed in the crockery basket and on the rack are improved since the rack can be arranged at different height positions on the crockery basket according to the space requirement of the items to be washed to be accommodated in the crockery basket or on the rack, for example, depending on the cup height. The present invention consequently also brings with it the advantage that the available space in the crockery basket can overall be better used. Further advantages of the crockery basket according to the present invention for dishwashers are also obtained from the following description of preferred embodiments.

In a particularly advantageous embodiment of the present invention, at least one device comprising a number of holding elements at different height positions is provided on the crockery basket, by which means the at least one rack can be arranged at different height positions. That is, a special device comprising a number of holding elements is provided, by which means at least one rack can be arranged at different height positions on the crockery basket where this device is provided on the crockery basket or on the rack itself as desired.

The device comprising a number of holding elements at different height positions is preferably detachably connected to the crockery basket so that the rack can be fixed on the crockery basket or removed from the crockery basket as required. The device comprising a number of holding elements for the rack can also be detachably connected to the rack so that the device is arranged on the crockery basket or on the rack itself as desired.

In a further advantageous embodiment of the dishwasher with height-adjustable racks according to the present invention, the device comprising a number of holding elements at different height positions comprises at least one fixing ladder which has a number of holding elements arranged substantially above one another at different height positions. In this way, a plurality of holding elements for the rack are provided at different height positions in the form of a fixing ladder, where preferably two fixing ladders are provided for each rack. The fixing ladders can in turn be detachably connected to the crockery basket so that the rack can be fixed on the crockery basket as required or the fixing ladders can be removed from the crockery basket.

The crockery basket consists for example of a wickerwork of plastic-coated wires, the crockery basket more appropriately comprising a number of substantially horizontal members arranged one above the other, on which at least one rack can be disposed at different height positions. In this case, the rack is fixed on the crockery basket by fixing structure which is preferably detachably arranged on the members of the crockery basket at different height positions. The fixing structure can thus be detachably connected to the crockery basket and to the rack.

It is especially advantageous if the fixing means on the rack and the holding elements of the device comprising a number of holding elements at different height positions or the fixing ladders are constructed as clamping connections by which means the rack is mounted preferably detachably on the crockery basket. This embodiment can be implemented particularly well if the fixing means on the rack and/or the device comprising a number of holding elements at different height positions or the fixing ladders are made of plastic. These plastic parts allow simple fixing on the crockery basket or on the rack and ensure that the clamping connection can be made reliably and durably without any wear.

It is furthermore advantageous if at least one rack is rotatably mounted in its holding element so that the rack can be pivoted between a substantially horizontal position and a substantially perpendicular position. As a result, the rack can not only be fixed at different height positions on the crockery basket but can also be pivoted so that it can be brought as required into a horizontal position to arrange items to be washed thereon or it can be brought into a perpendicular position to enlarge the storage space in the crockery basket.

The rack is preferably provided with at least one mechanical stop with which the rack is supported on the crockery basket to hold the rack in a substantially horizontal position. Alternatively, the fixing means on the rack and/or the device comprising a number of holding elements at different height positions or the fixing ladders can have at least one mechanical stop with which the rack is supported to hold the rack in a substantially horizontal position. The stability of the rack for example when loaded with heavy items to be washed, can thereby be increased.

The present invention is explained in detail hereinafter using two exemplary embodiments with reference to the drawings. In the figures.

Figure 1:
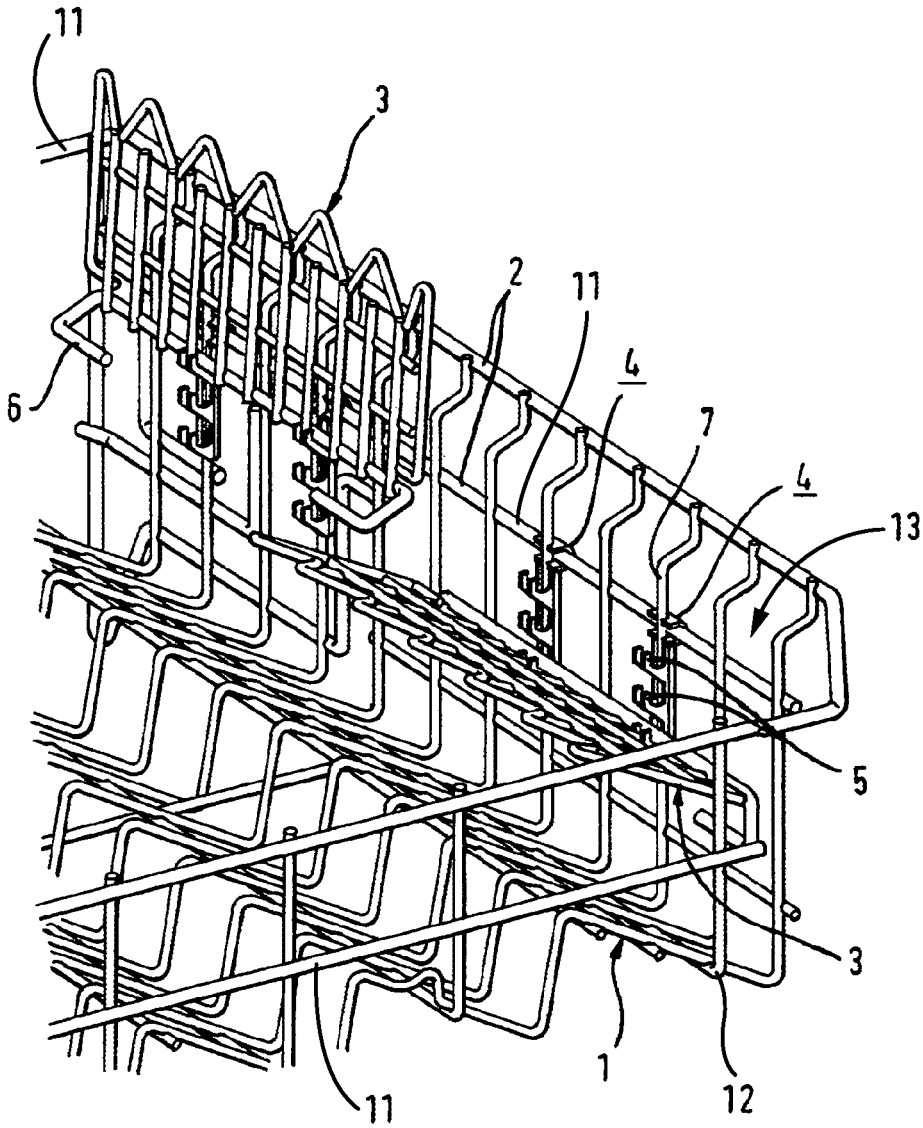
FIG. 1 is a perspective view of a part of a first embodiment of the crockery basket with height-adjustable racks according to the present invention.

The crockery basket 1 according to the invention shown in FIG. 1 consists of a wickerwork of plastic-coated wires where the crockery basket 1 comprises a number of horizontal members 2 arranged one above the other at its edge.

Provided in the crockery basket 1 are two pivotable racks 3 for items to be washed, of which one rack 3 is shown in a horizontal position in which it can be filled with items to be washed and the other rack 3 is shown in a vertical position. The racks 3 are each fitted with supporting clips 6 which form a mechanical stop for the pivoting movement whereby the racks 3 are supported in the horizontal position to improve the stability of the racks 3 for example when the crockery basket 1 is loaded with heavy items to be washed.

The crockery basket 1 has a plurality of devices or fixing ladders 4 with holding elements 5 at different height positions for racks 3 which are each arranged at the point of intersection between horizontal members 2 and perpendicular wires 7 on the crockery basket 1. In the present exemplary embodiment the fixing ladders 4 are made of plastic and are detachably connected to the crockery basket 1. In this first embodiment of the crockery basket 1 according to the invention two fixing ladders 4 are provided for each rack 3.

FIG. 1 illustrates a portion of the crockery basket 1 where side walls 11, a bottom 12, and a top 13 are illustrated. The top 13 is open (without a wickerwork of plastic-coated wires) whereas the side walls 11 and the bottom include a wickerwork of plastic-coated wires. The two fixing ladders 4 for a given rack 3 are disposed on the same side wall.

Figure 2:
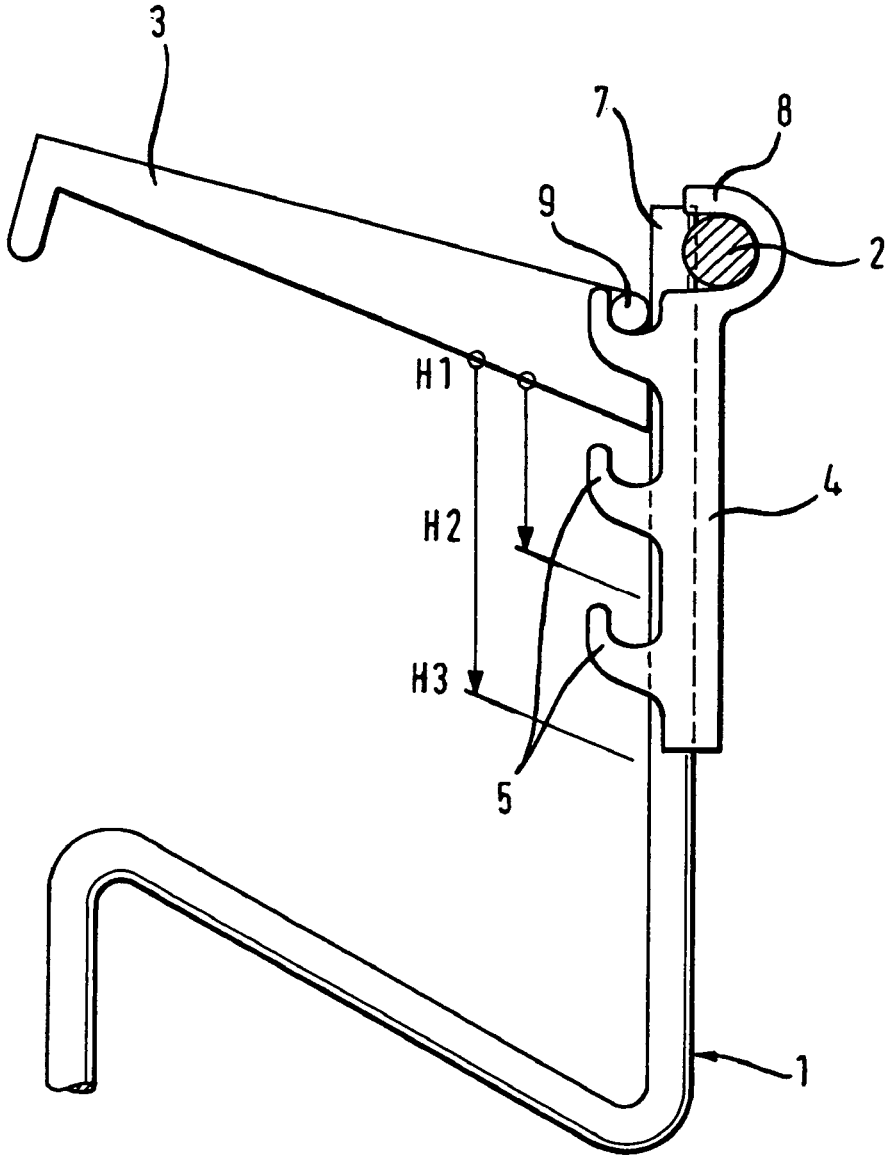
FIG. 2 is a sectional view of a detail of the crockery basket with height-adjustable.

FIG. 2 shows a sectional view of a detail of the crockery basket 1 with height-adjustable racks 2 according to the present invention. It can be seen in FIG. 2 that the fixing ladders 3 each comprise three holding elements 5 for the rack 3 which are arranged at different heights H1, H2 and H3. The rack 3 has pivot pins 9 which engage with the holding elements 5. In order to arrange the rack 3 at different height positions H1, H2 and H3, the pivot pins 9 of the rack 3 are inserted into the corresponding holding elements 5 of the fixing ladders 4.

In this case, the engagement between the pivot pin 9 of the rack 3 and the holding elements 5 of the fixing ladders 4 is preferably constructed as a clamping connection to ensure that the rack 3 is held securely during the washing operation of the dishwasher. The clamping connection between the pivot pin 9 of the rack 3 and the holding elements 5 of the fixing ladders 4 also allows pivoting movement of the rack 3 about the axis of the pivot pin 9 in each of the holding elements at different height positions H1, H2 and H3.

The fixing elements 4 are constructed with a groove which extends through the entire length of the fixing ladders 4 and with these partly encloses a perpendicular wire 7 of the crockery basket 1. At their upper end the fixing ladders 4 have retaining clips 8 which partly surround a horizontal member 2 of the crockery basket 1. In this way, the fixing ladders 4 are firstly fixed on a perpendicular wire 7 of the crockery basket 1 by means of the groove and secondly are fixed in their position on a horizontal member 2 of the crockery basket 1 by means of the retaining clip 8. Since the fixing ladders 4 can be detachably connected to the crockery basket 1 as separate elements, they can also be retro-fitted to known crockery baskets having perpendicular and horizontal members.

Figure 3:
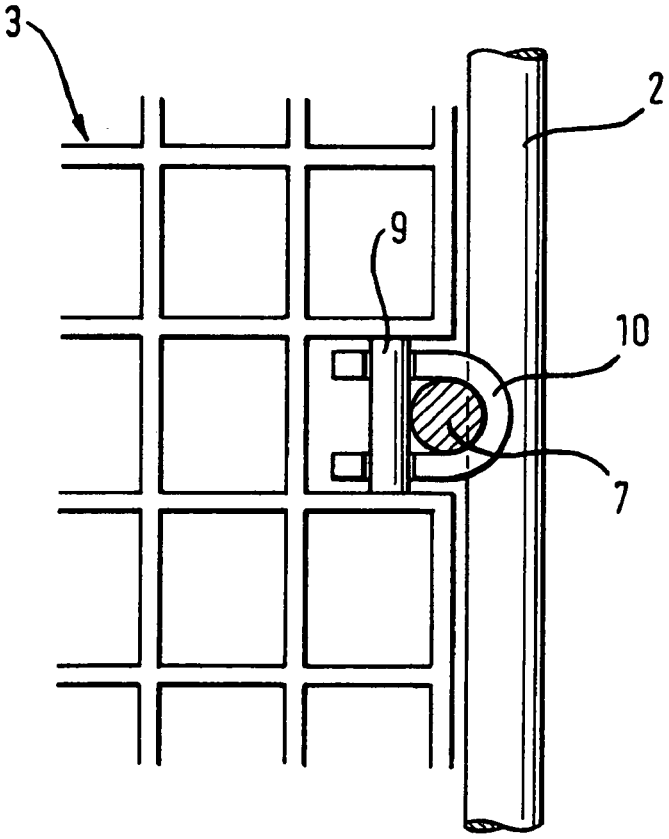
FIG. 3 is a sectional view of a detail of a second embodiment of the crockery basket with height-adjustable racks according to the present invention.

FIG. 3 shows a sectional view of a detail of the crockery basket with height-adjustable racks according to the present invention. In this second embodiment, instead of the fixing ladders 4 a holding device 10 having only one holding element for the rack 3 is provided. The holding device 10 is arranged at the point of intersection between a horizontal member 2 and a perpendicular wire 7 on the crockery basket 1. The holding device 10 substantially consists of a U-shaped leg which partially encloses the perpendicular wire 7 of the crockery basket 1 and is supported by the horizontal member 2 of the crockery basket 1. Formed at the free ends of the U-shaped leg are grooves in which the pivot pin 9 of the rack can be inserted. The engagement between the pivot pin 9 of the rack 3 and the holding device 10 is preferably constructed as a clamping device to ensure a secure hold and ensure a pivoting movement of the rack 3 about the axis of the pivot pin 9 of the rack 3.

The height adjustability of the rack is obtained in this embodiment by providing a plurality of holding devices 10 with a holding element for the rack 3 at different height positions on the crockery basket 1. As a result, the rack 3 can be arranged at those height positions on the crockery basket 1 where a point of intersection between a horizontal member 2 and a perpendicular wire 7 of the crockery basket 1 with such a holding device 10 is located. The holding device 10 can either be arranged detachably on the crockery basket 1 or embodied as a fixed component of the crockery basket 1 for example, made of plastic-coated wire.

REFERENCE LIST

1 Crockery basket
2 Horizontal members of crockery basket 1
3 Rack or rack for items to be washed
4 Device comprising holding elements for the rack 3 at different height positions or fixing ladder
5 Holding elements at different height positions
6 Mechanical stop on rack 3
7 Perpendicular wires of crockery basket 1
8 Retaining clips of fixing ladder 4
9 Pivot pin on rack 3
10 Holding device for holding element of rack 3
H1 First height position of rack 3
H2 Second height position of rack 3
H3 Third height position of rack 3

The invention claimed is:

1. A crockery basket comprising:

a framework to retain items to be washed;

at least one rack to engage items to be washed to support the retention of such items relative to the framework; and a plurality of holding elements to hold the at least one rack at different height positions on the crockery basket, wherein the framework includes at least one horizontal member and at least first and second vertical wires intersecting with the horizontal member along a single side of framework, and wherein a first one of the plurality of holding elements engages the framework at a first intersection between the horizontal member and the first vertical wire along the single side, and a second one of the plurality of holding elements engages the framework at a second intersection between the horizontal member and the second vertical wire along the single side.

2. The crockery basket according to claim 1, wherein each of the holding elements includes first and second arm or leg portions extending on opposite sides of a respective one of the first and second vertical wires to support a pivot pin of the rack.

3. A crockery basket comprising:

a framework to retain items to be washed;

at least one rack having an upper surface to support the items relative to the framework, said rack having a pivot pin about which the rack is pivotable; and a plurality of holding elements to hold the at least one rack at different height positions on the crockery basket, wherein the at least one rack is pivotable about the pivot pin between generally horizontal and vertical positions, the rack including a supporting clip to form a mechanical stop abuttable with a vertical wire of the framework when the rack is in the generally horizontal position.

4. The crockery basket according to claim 3, wherein the supporting clip is formed as an extension of and in one piece with the pivot pin.

5. The crockery basket according to claim 4, wherein the pivot pin and supporting clip are generally parallel to one another.

6. The crockery basket according to claim 4, wherein the pivot pin is generally parallel to a horizontal member to which the holding elements are secured.

7. A crockery basket comprising:

a framework to retain items to be washed, the framework including a vertical wire;

at least one rack to engage items to be washed to support the retention of such items relative to the framework, said rack including a pivot pin about which the rack may be pivoted; and at least one device to hold the at least one rack at different height positions on the crockery basket, the at least one device being secured to the framework, the at least one device including a pair of arms that straddle the vertical wire of the framework, each of said arms extending inside the framework and including a hook-shaped member to support the pivot pin.

8. The crockery basket according to claim 7, wherein the device remains secured to the framework as the rack moves between the different height positions of the device.

* * * * *